US005231368A

United States Patent [19]

Buckshaw et al.

[11] Patent Number: 5,231,368

[45] Date of Patent: Jul. 27, 1993

[54] TEMPERATURE OPERATED SWITCH CONSTRUCTION, TERMINAL BLOCK THEREFOR AND METHODS OF MAKING THE SAME

[75] Inventors: Thomas M. Buckshaw, Indiana; Joseph J. Erdelsky, Jeannette; David M. Martin, Dunbar, all of Pa.

[73] Assignee: Robertshaw Controls Company, Richmond, Va.

[21] Appl. No.: 969,984

[22] Filed: Nov. 2, 1992

Related U.S. Application Data

[60] Division of Ser. No. 869,160, Apr. 14, 1992, Pat. No. 5,182,539, which is a continuation-in-part of Ser. No. 688,157, Apr. 19, 1991, Pat. No. 5,148,142.

[51] Int. Cl.[5] ..... H01H 37/36; H01H 87/00

[52] U.S. Cl. ..... 337/329; 337/122; 335/207

[58] Field of Search ..... 337/329, 330, 331, 332, 337/373, 413, 137, 122, 302, 303, 304; 335/205, 206, 207

[56] References Cited

U.S. PATENT DOCUMENTS 4,054,245 10/1977 Bennetsen et al. ..... 337/329
4,246,457 1/1981 Teichert et al. ..... 200/303

*Primary Examiner*—Harold Broome
*Attorney, Agent, or Firm*—Candor, Candor & Tassone

[57] ABSTRACT

A temperature operated switch construction, terminal block therefor and methods of making the same are provided, the switch construction comprising a housing, a movable switch arm carried in the housing, a temperature actuated unit disposed in the housing and being operatively interconnected to the switch arm to cause movement of the arm between operating positions thereof in relation to the temperature being sensed by the temperature actuated unit, the housing comprising a main part and a removable terminal block carried by the main part, the terminal block carrying a switch unit that is operatively associated with the switch arm so that the switch unit is in a first condition thereof when the switch arm is in a first operating position thereof and the switch unit is in a second condition thereof when the switch arm is in a second operating position thereof, the switch unit comprising a reed switch and the switch arm carrying a magnet for operating the reed switch to the conditions thereof as the switch arm is moved to the positions thereof.

18 Claims, 6 Drawing Sheets

TEMPERATURE OPERATED SWITCH CONSTRUCTION, TERMINAL BLOCK THEREFOR AND METHODS OF MAKING THE SAME

CROSS REFERENCE TO RELATED APPLICATION

This application is a divisional patent application of its copending parent patent application, Ser. No. 869,160, filed Apr. 14, 1992, now U.S. Pat. No. 5,182,539 which, in turn, is a Continuation-in-Part patent application of its copending parent U.S. patent application Ser. No. 688,157, filed Apr. 19, 1991, now U.S. Pat. No. 5,148,142.

BACKGROUND OF THE INVENTION

1. Field of the Invention

This invention relates to a new temperature operated switch construction and to a new terminal block for such a switch construction as well as to new methods of making such a temperature operated switch construction and such a terminal block.

2. Prior Art Statement

It is known to provide a temperature operated switch construction comprising a housing means, a movable switch arm carried in the housing means, temperature actuated means disposed in the housing means and being operatively interconnected to the switch arm to cause movement of the switch arm between operating positions thereof in relation to the temperature being sensed by the temperature actuated means, the housing means comprising a main part and a removable terminal block carried by the main part, the terminal block carrying a switch means that is operatively associated with the switch arm so that the switch means is in a first condition thereof when the switch arm is in a first operating position thereof and the switch means is in a second condition thereof when the switch arm is in a second operating position thereof. For example, see FIGS. 1 and 2 of this application.

It is also known to operate a reed switch means through the movement of a switch arm that carries a magnet means. For example, see FIGS. 4 and 5 of this application.

It is also known to move such switch arm for influencing the operating condition of a reed switch means by temperature actuated means. For example, see the U.S. Pat. No. to Teichert et al, No. 4,246,457.

SUMMARY OF THE INVENTION

It is a feature of this invention to provide a new temperature operated switch construction wherein a reed switch means is utilized therein in a unique manner.

In particular, it has been found according to the teachings of this invention that a certain temperature operated switch construction or thermostat that normally has a switch arm moved by temperature actuated means so as to place contact means of that switch arm into electrical contact with or out of electrical contact from contact means carried by a terminal block of the switch construction is subject to the adverse effects of abnormal environments, such as elevated temperatures, light electrical loads and the presence of cooking oil vapors and greases.

Therefore, it was also found according to the teachings of this invention that the basic structure of such a temperature operated switch construction can be utilized with a hermetically sealed reed switch by replacing the contact means on the switch arm with a permanent magnet means and providing a special terminal block to replace the terminal block of the temperature operated switch construction, such new terminal block having the reed switch mounted thereon so that the reed switch contacts make and break as the magnet means changes position relative to the location of the reed switch.

Such switch arm can be an arm that pivots toward and away from the switch means or can be an arm that moves in a generally straight-line manner without pivoting and the switch construction can have one or both types of switch arms therein, as desired.

For example, one embodiment of this invention comprises a temperature operated switch construction comprising a housing means, a first movable switch arm carried in the housing means, temperature actuated means disposed in the housing means and being operatively interconnected to the first switch arm to cause movement of the first switch arm between operating positions thereof in relation to the temperature being sensed by the temperature actuated means, the housing means comprising a main part and a first removable terminal block carried by the main part, the first terminal block carrying a first switch means that is operatively associated with the first switch arm so that the first switch means is in a first condition thereof when the first switch arm is in a first operating position thereof and the first switch means is in a second condition thereof when the first switch arm is in a second operating position thereof, the first switch means comprising a first reed switch means and the first switch arm carrying a first magnet means for operating the first reed switch means to the conditions thereof as the first switch arm is moved to the positions thereof, a second movable switch arm carried by the housing means, actuator means carried by the housing means and being operatively interconnected to the second switch arm to cause movement of the second switch arm between operating positions thereof in relation to the condition of the actuator means, and a second removable terminal block carried by the main part of the housing means, the second terminal block carrying a second switch means that is operatively associated with the second switch arm so that the second switch means is in a first condition thereof when the second switch arm is in a first operating position thereof and the second switch means is in a second condition thereof when the second switch arm is in a second operation position thereof, the second switch means comprising a second reed switch means and the second switch arm carrying a second magnet means for operating the second reed switch means to the conditions thereof as the second switch arm is moved to the positions thereof in a direction that is generally parallel to the second reed switch means.

Accordingly, it is an object of this invention to provide a new temperature operated switch construction having one or more of the novel features of this invention as set forth above or hereinafter shown or described.

Another object of this invention is to provide a new method of making such a temperature operated switch construction, the method of this invention having one or more of the novel features of this invention as set forth above or hereinafter shown or described.

Another object of this invention is to provide a new terminal block for such a temperature operated switch construction, the terminal block of this invention having one or more of the novel features of this invention as set forth above or hereinafter shown or described.

Another object of this invention is to provide a new method of making such a terminal block, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
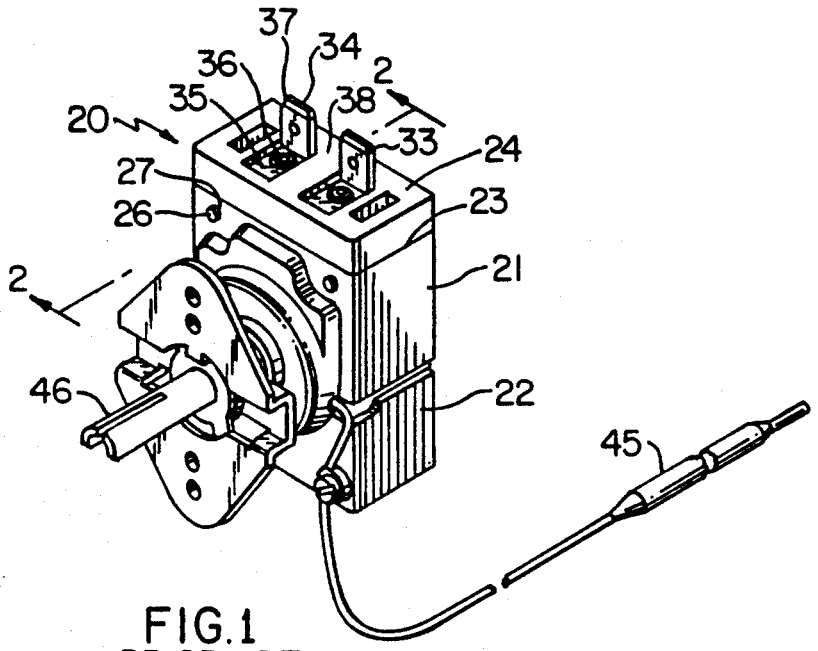
FIG.1 PRIOR ART
FIG. 1 is a front perspective view of a prior known temperature operated switch construction.

While the various features of this invention are hereinafter illustrated and described as being particularly adapted to provide a temperature operated switch construction of a certain configuration, it is to be understood that the various features of this invention can be utilized singly or in various combinations thereof to provide structure for other types of temperature operated switch constructions, as desired.

Therefore, this invention is not to be limited to only the embodiments thereof that are illustrated in the drawings, because the drawings are merely utilized to illustrate one of the wide variety of uses of this invention.

Figure 2:
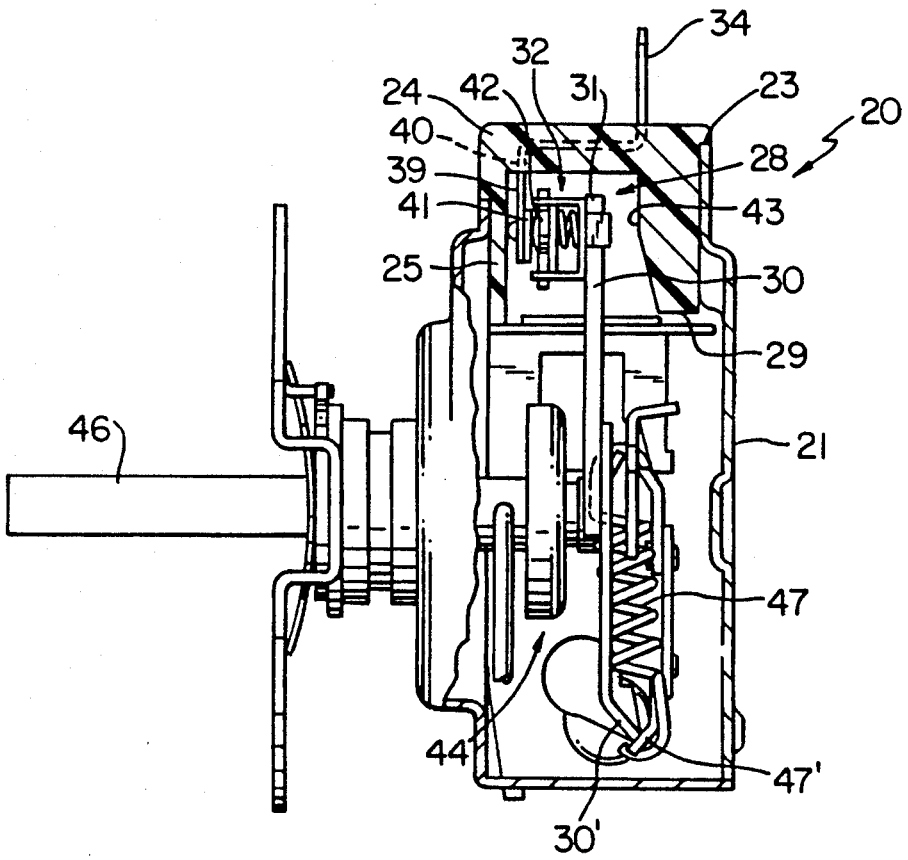
FIG.2 PRIOR ART
FIG. 2 is an enlarged fragmentary cross-sectional view taken on line 2—2 of FIG. 1.

Referring now to FIGS. 1 and 2, a prior known temperature operated switch construction is generally indicated by the reference numeral 20 and comprises a housing means 21 formed of a metallic casing or part 22 having an open end 23 in which a terminal block 24 has a portion 25 thereof disposed therein and being secured thereto by threaded fastening members 26 passing through suitable openings 27 in the casing 22 and aligned openings (not shown) in the terminal block 24 to hold the terminal block 24 in its assembled relation as illustrated in FIGS. 1 and 2 in a manner well known in the art.

The terminal block 24 is formed of electrically insulating material, such as polymeric material, and has a cavity 28 therein that interrupts a lower surface means 29 thereof so that a movable arm 30 can have an end 31 thereof project into the cavity 28 and be movable therein as will be apparent hereinafter, the movable arm 30 operating an electrical switch means that is generally indicated by the reference numeral 32 in FIG. 2 and is carried by the terminal block 24.

In particular, the switch means 32 comprises two like conductive terminals 33 and 34 each having an intermediate portion 35 secured to the terminal block 24 by a fastening means 36 so that an upstanding portion 37 thereof projects upwardly from a top surface 38 of the terminal block 24 and another portion 39 thereof extends through an opening 40 in the terminal block 24 to project into the cavity 28 and carry a contact 41 thereon.

The end 31 of the switch arm 30 carries a contact bar means 42 that is adapted to engage against the contacts 41 of the terminals 33 and 34 so as to conductively bridge or electrically interconnect the same together when the arm 30 is in its left-hand position as illustrated in FIG. 2. However, when the arm 30 is moved to the right so as to engage against a stop surface 43 of the terminal block 24, the bridging contact member 42 is held out of contact with the contacts 41 of the terminals 33 and 34 so as to prevent electrical connection therebetween.

In this manner, the terminals 33 and 34 can be interconnected by suitable external leads (not shown) to any desired means, such as a load means, to be operated only when the switch arm 30 is holding the contact bar means 42 in electrical contact with the contacts 41.

The switch blade 30 is moved between its operating positions by a temperature actuated means that is generally indicated by the reference numeral 44 in FIG. 2 and has a temperature sensing bulb 45 and a selector shaft 46, all parts that are well known in the art whereby the setting of the selector shaft 46 determines the temperature that the temperature sensing bulb 45 senses to cause the switch blade 30 to be disposed in the contact closing condition of FIG. 2 and what temperature the temperature sensing bulb 45 senses to move the switch arm 30 out of the contact closing position thereof all in a manner well known in the art.

For example, while the switch blade 30 of the temperature operated switch construction 20 is adapted to be snapped between its operating positions by spring means 47 and having its lower end 30' pivotally mounted to lever structure 47', it is to be understood that any suitable temperature actuated means can be utilized to move the switch blade 30 to its pivoted left-hand position as illustrated in FIG. 2 and to its right-hand pivoted position wherein the same is engaging against the stop means 43 as desired.

Such a temperature operated switch construction or thermostat 20 is a part well known in the art and can be purchased as a K thermostat from the Robertshaw Controls Company of Richmond, Virginia.

However, as previously stated, it is a feature of this invention to replace the switch means 32 of the temperature operated switch construction 20 with a reed switch means that is uniquely carried by a terminal block assembly that is adapted to replace the terminal block 24 of the switch construction 20 so as to form a new temperature operated switch construction that still utilizes a major portion of the previously designed parts.

Figure 3:
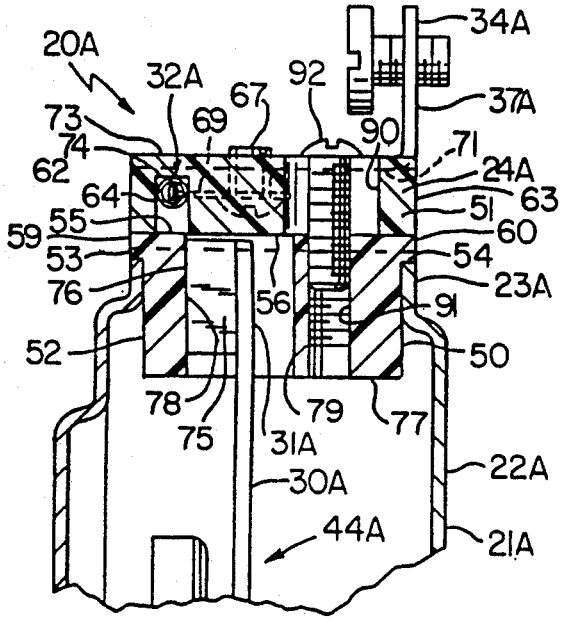
FIG. 3 is a fragmentary view similar to FIG. 2 and illustrates the new temperature operated switch construction of this invention.

In particular, reference is now made to FIG. 3 wherein the new temperature operated switch construction of this invention is generally indicated by the reference numeral 20A and parts thereof similar to the switch construction 20 previously described are indicated by like reference numerals followed by the reference letter "A".

As illustrated in FIG. 3, the temperature operated switch construction 20A of this invention includes the housing means 21A, the temperature actuated means 44A and the switch arm 30A, the housing means 21A comprising the casing 22A previously described and having the open end 23A thereof closed by a new terminal block means 24A of this invention and that carries a switch means 32A in a manner hereinafter set forth.

The terminal block 24A of this invention is formed of electrically insulating material, such as polymeric material, and is formed of two parts 50 and 51 adjustably secured together in a manner hereinafter set forth, the part 50 having a lower substantially rectangular section 52 that fits into the open end 23A of the casing 22A and has an outwardly directed rectangular flange 53 that will rest against the top surface 54 of the casing 22A when the section 52 is fully inserted therein in the manner illustrated in FIG. 3 whereby a substantially flat surface 55 on the part 50 faces outwardly from the casing 22A.

The part 51 of the terminal block 24A is also substantially rectangular in configuration and has a substantially flat surface 56 that is adapted to be disposed against the flat surface 55 of the part 50, the surfaces 55 and 56 being adapted to permit sliding movement therebetween except that the surfaces 55 and 56 respectively have spline means 57 limiting such sliding movement in one axial direction relative to each other.

For example, the spline means 57 comprises an upstanding projection or flat rib 58 on the surface 55 of the part 50 that extends from one end 59 to the other end 60 of the flange 53 thereof while the surface 56 has a cooperating slot or groove 61 formed therein and extending from one side 62 to the other side 63 thereof as illustrated. Of course, the spline means 57 could be a dovetailed arrangement if desired and/or could comprise more than one cooperating rib means and groove means if desired.

The surface 56 of the part 51 of the terminal block 24A is interrupted by a recess 64 that has an intermediate portion 65 in which the switch means 32A is disposed and has end portions 66 wherein threaded fastening members 67 and 68 are disposed and are adapted to respectively electrically interconnect leads 69 and 70 of the switch means 32A respectively to legs 71 of the terminals 33A and 34A which are held in suitable grooves 72 in the top surface 73 of the part 51 as illustrated in any suitable manner, such as by the same fastening means 67 and 68 as illustrated. In this manner, the upstanding parts 37A of the terminals 33A and 34A can be respectively interconnected to an external load means as desired and as previously described.

Figure 6:
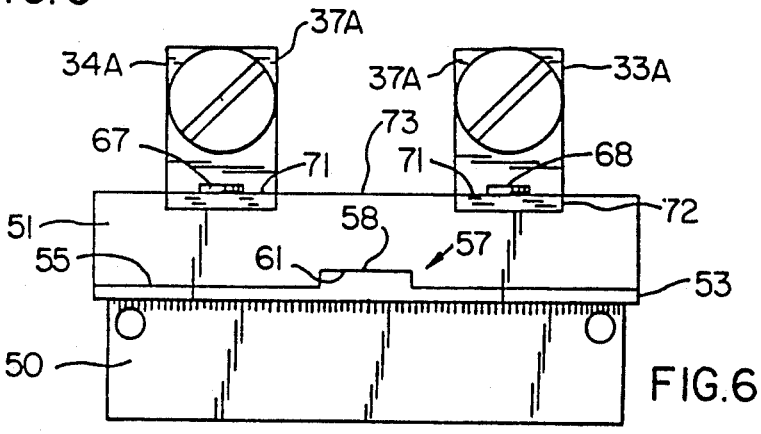
FIG. 6 is a front view of the terminalblock of this invention that is utilized in the temperature operated switch construction of FIG. 3.
Figure 7:
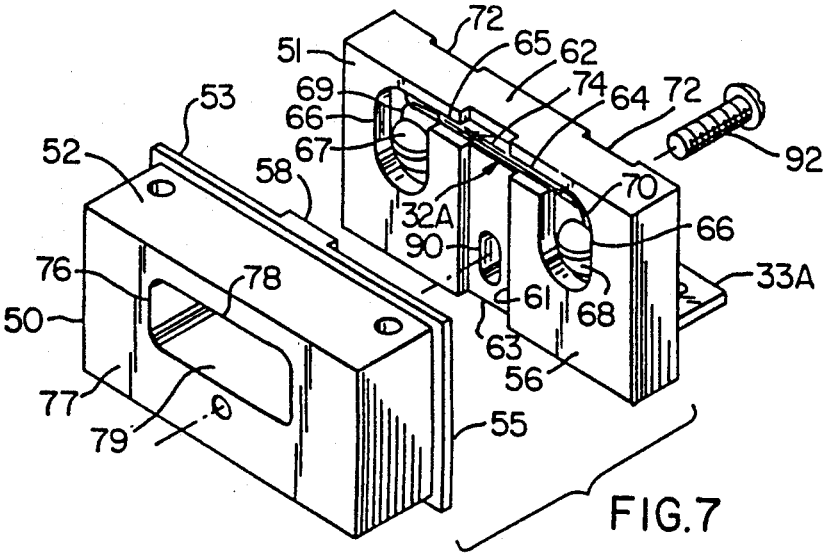
FIG. 7 is an exploded perspective view of the two parts of the housing block construction of FIG. 6.

The switch means 32A of this invention comprises a hermetically sealed reed switch 74 that can be of the normally open or the normally closed type and is adapted to be influenced by the magnetic field of a permanent magnet 75 that is carried on the end 31A of the switch blade 30A as illustrated in FIG. 6.

In particular, the part 50 of the terminal block 24A has an opening 76 passing through the opposed surfaces 55 and 77 thereof, the opening 76 being substantially oblong and rectangular in configuration so as to define opposed facing substantially parallel stop surfaces 78 and 79 as illustrated in FIG. 3 whereby the end 31A of the switch blade 30A is adapted to project into the opening 76 and be moved therein from its left-hand position as illustrated in FIG. 3 wherein the magnet 75 is engaged against the stop surface 78 and to the right until the switch blade 30A engages against the stop surface 79 so that such movement of the magnet means 75 influences the operating condition of the reed switch 74 in a manner well known in the art.

Figure 4:
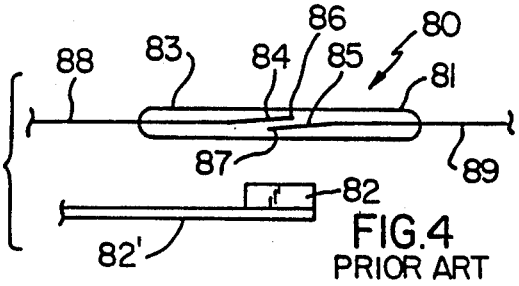
FIG.4 PRIOR ART
FIG. 4 is a schematic view illustrating a prior known reed switch means, FIG. 4 illustrating the reed switch in an open condition thereof.
Figure 5:
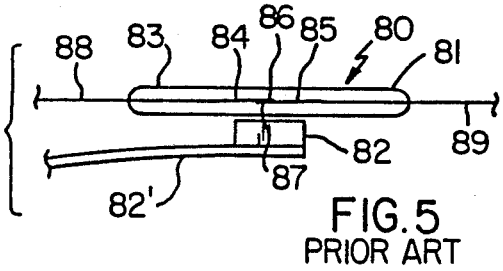
FIG.5 PRIOR ART
FIG. 5 is a view similar to FIG. 4 and illustrates the reed switch means in a closed condition thereof.

For example, reference is now made to FIGS. 4 and 5 wherein a prior known reed switch means is generally indicated by the reference numeral 80 and comprises a reed switch 81 and a movable magnet means 82, the reed switch 81 having a hermetically sealed glass envelope 83 containing two switch blades 84 and 85 therein that normally have the respective ends 86 and 87 thereof disposed spaced apart from each other through the natural resiliency of the blades 84 and 85 whereby electrical current cannot flow through the reed switch 81 from an external lead 88 of the switch blade 84 to an external lead 89 of the switch blade 85. However, when the permanent magnet 82 is moved toward the reed switch 81 in the manner illustrated in FIG. 5, such as by movement of a switch blade 82' carrying the permanent magnet 82, the magnetic field of the magnet 82 causes the ends 86 and 87 of the switch blades 84 and 85 to move together in the manner illustrated in FIG. 5 and thereby close the switch 81 so that electrical current can flow between the external leads 88 and 89 through the switch means 81 all in a manner well known in the art.

Thus, when the switch blade 82' moves the permanent magnet 82 away from the switch 81 a certain distance, the reduced magnetic field being imposed on the ends 86 and 87 of the switch blades 84 and 85 is insufficient to overcome the natural resiliency of the blades 84 and 85 so that the ends 86 and 87 can again move apart in the manner illustrated in FIG. 4 and thereby prevent electrical connection between the leads 88 and 89.

Of course, as previously stated the reed switch 81 can be of the type that is normally closed so that the movement of the magnet 82 toward the reed switch 81 opens the contacts rather than close the same as is well known in the art.

In any event, it can be seen that the reed switch 74 of the terminal block 24A of this invention will be in one condition thereof when the magnet 75 is disposed against the stop wall 78 of the part 50 of the terminal block 24A and the switch 74 will be in the other operating condition thereof when the blade 30A is against the stop wall 79, such movement of the switch blade 30A being under the control of the temperature actuated means 44A sensing certain temperature conditions as previously set forth.

However, in order to provide means for adjusting the location of the switch 74 relative to the magnet 75, the part 50 can slide relative to the part 51 so that the position of the switch 74 relative to the magnet 75 when the magnet 75 is against the stop surface 78 can be adjusted.

In particular, an elongated opening 90 is formed through the part 51 and is aligned with a threaded opening 91 in the part 50 so that a threaded fastening member 92 can pass through the slot or elongated opening 90 and be received in the threaded opening 91 of the part 50 to securely fasten the parts 51 and 50 together in the adjusted position of the part 51 on the part 50 for the reasons previously set forth.

In this manner, it will be assured that the magnet 75 will change the operating condition of the switch 74 when the magnet 75 is moved against the stop surface 78.

Therefore, it can be seen that it is a relatively simple method of this invention to convert the switch construction 20 of FIGS. 1 and 2 to utilize the terminal block 24A of this invention as well as the permanent magnet 75 and thereby permit the resulting switch construction 20A of this invention to be utilized in abnormal environments such as provided by the presence of cooking oil vapors and greases so that the internal workings of the switch 74 will not be affected by such adverse environments as would be the case with the contacts 41 and 42 of the switch means 32 previously described.

For example, the contact means 42 of the switch blade 30 of FIG. 2 can be removed and the permanent magnet 75 can be secured on the end 31 of the switch arm 30 to produce the switch arm 30A as illustrated in FIG. 3 and the terminal block 24 can be removed to be replaced by the new terminal block 24A by utilizing the same fastening means 27 of FIG. 1 to secure the terminal block 24A in place whereby the resulting new switch construction 20A of this invention will operate in a manner now to be described.

When the temperature being sensed by the temperature actuated means 44A is at a certain temperature that has been previously selected by the selector shaft (not shown but similar to the selector shaft 46 previously described) the temperature actuated means 44A moves and holds the switch blade 30A against the stop means 78 in the manner illustrated in FIG. 3 so that the magnet 75 causes the switch means 32A to be in a certain operating condition thereof, such as electrically interconnecting the terminals 33A and 34A together whereas when the temperature being sensed by the temperature actuated means 44A is at another temperature, the temperature actuated means 44A moves the switch blade 30A and holds the same against the stop means 79 so that the magnet 75 now permits the switch means 32A to be in the other condition thereof, such as electrically disconnecting the terminals 33A and 34A from each other.

In this manner, it can be seen that the switch construction 20A is a single pole single throw arrangement that can have the contacts of the reed switch 74 open on temperature rise. However, by changing the location of the reed switch 74 relative to the magnet 75, such as being adjacent the stop surface 79, it can be seen that the result would produce a single pole single throw that would close on temperature rise.

Similarly, a double pole single throw arrangement could be provided by utilizing two reed switches in the terminal block of this invention.

Figure 8:
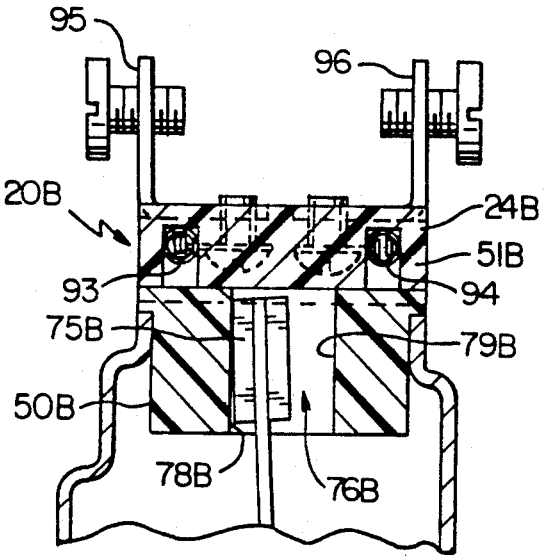
FIG. 8 is a view similar to FIG. 3 and illustrates another temperature operated switch construction of this invention.
Figure 9:
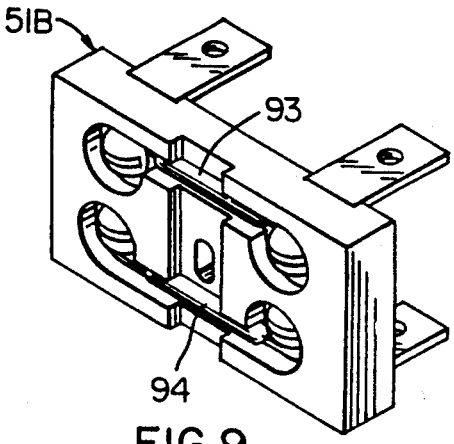
FIG. 9 is a perspective view of one of the parts of the terminal block of the switch construction of FIG. 8.
Figure 10:
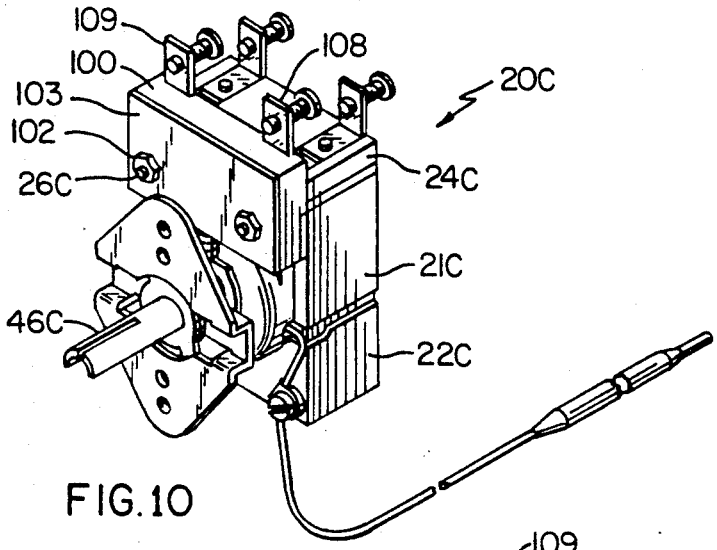
FIG. 10 is a view similar to FIG. 1 and illustrates another temperature operated switch construction of this invention.

In particular, reference is now made to FIGS. 8 and 9 wherein another temperature operated switch construction of this invention is generally indicated by the reference numeral 20B and parts thereof similar to the switch construction 20A previously described are indicated by like reference numerals followed by the reference letter "B".

As illustrated in FIGS. 8 and 9, the part 51B of the terminal block 24B carries two reed switches 93 and 94 so located relative to the opening 76B in the part 50B of the terminal block 24A, that the switch 93 will be in a closed condition when the magnet 75B is against the stop 78B and the switch 94 will be in an open condition whereas when the magnet 75B is moved against the stop 79B, the switch 93 will be in an open condition and the switch 94 will be in a closed condition.

In this manner, the switch 93 would control the terminal means 95 and the switch means 94 would control the terminal means 96 in a double pole single throw manner.

Thus, it can be seen that many arrangements can be provided by the unique terminal block and permanent magnet means of this invention and by providing the terminal block in two parts so that one part can be adjusted relative to the other part, fine tuning of the arrangement can be provided so that the magnet will properly operate the reed switch means in the desired manner.

Another temperature operated switch construction of this invention is generally indicated by the reference numeral 20C in FIGS. 10-16 and parts thereof similar to the parts of the temperature operated switch constructions 20, 20A and 20B previously described are indicated by like reference numerals followed by the reference letter "C".

The temperature operated switch construction 20C comprises a housing means 21C that has a main part or casing 22C carrying a removable terminal block 24C with the terminal block 24C illustrated in the drawings being substantially identical to the terminal block 24A previously described.

Figure 15:
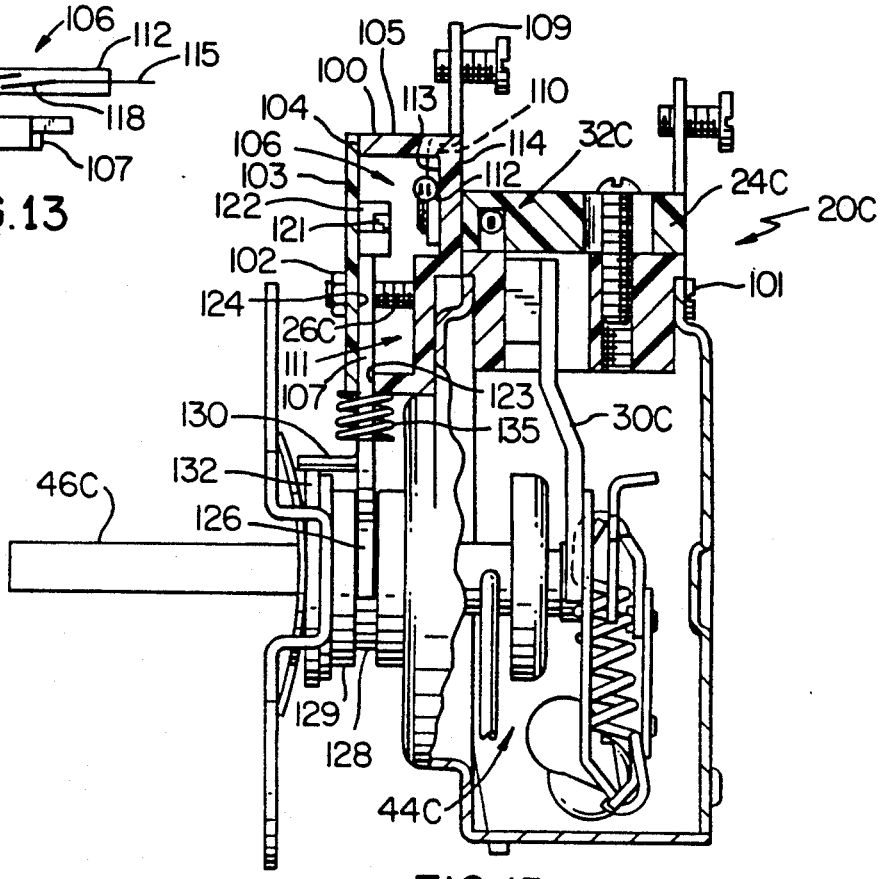
FIG. 15 is a cross-sectional view, partially in elevation, taken on line 15—15 of FIG. 11.

However, another removable terminal block 100 of this invention is also carried by the main part 22C and forms part of the housing means 21C, the terminal block 100 being fastened to the main part or casing 22C by fastening members 26C that have an enlarged head 101 engaging against the casing 22C and passing through suitable aligned openings in the terminal block 24C and in the terminal block 100 to have threaded fastening members or nuts 102 disposed thereon and engaging against a cover member 103 of the terminal block 100 to not only hold the terminal blocks 100 and 24C to the casing 22C, but also to hold the cover member 103 of the terminal block 100 in a manner to close an open end 104 of a cup-shaped part 105 of the terminal block 100 as illustrated in FIG. 15.

The terminal block 100 of the temperature operated switch construction 20C carries a switch means therein that is generally indicated by the reference numeral 106 and is controlled by a switch arm 107 that is moved by the rotation of a control shaft 46C in a manner hereinafter set forth whereby it can be seen that the switch means 106 is a switch that is an addition to a switch means 32C that is disposed in the housing means 24C and controlled by a switch arm 30C under the control of the temperature actuated means 44C in the manner previously set forth for the temperature operated switch construction 20A.

Therefore, it can be seen that the temperature operated switch construction 20C of this invention has two switch means 32C and 106 therein to be respectively controlled by the setting of the control shaft 46C in a manner hereinafter set forth is, therefore, similar to two switch temperature operated switch constructions that are well known in the art.

For example, see FIGS. 12–22 of the U.S. Pat. No. to Sigler, No. 5,020,389, whereby this U.S. Pat. No. is being incorporated into this disclosure by this reference thereto.

Thus, it is well known that the control shaft 46C of the temperature operated switch construction 20C is adapted to set the temperature setting of the temperature actuated means 44C for operating the switch means 32C and that when the control shaft 46C is set in a certain position thereof, the same operates the switch means 106 to be in a closed condition thereof so as to interconnect two terminals 108 and 109 together, the terminals 108 and 109 being carried by the removable terminal block 100 in the manner illustrated in the drawings and projecting through suitable slot means 110 in the cup-shaped housing member 105 to respectively have parts 108' and 109' disposed within the cavity or chamber 111 defined within the terminal block 100.

Since the structure and operation of the switch means 32C by the switch arm 30C of the temperature operated switch construction 20C is identical to the structure and operation of the switch means 32A and switch arm 30A of the temperature operated switch construction 20A previously described, it is deemed unnecessary to further describe the switch means 32C and switch arm 30C.

In regard to the switch means 106 of the terminal block 100 of the temperature operated switch construction 20C, it can be seen that the same comprises a reed switch 112 held in the cavity 111 of the terminal block 100 and against a surface 113 of a closed end wall 114 of the cup-shaped member 105 and having the opposed external leads 115 and 116 thereof respectively fastened to the portions 108' and 109' of the terminals 108 and 109 by fastening means 117, such as rivets, that also electrically interconnect the leads 115 and 116 to the terminals 108 and 109 at the portions 108' and 109' thereof.

Thus, the reed switch means 112 is fixed in the terminal block 100 so that a longitudinal axis thereof extends between the fastening means 117, the reed switch means 112 having internal contact means 118 and 119 disposed inside a cylindrical sealed glass envelope or sleeve 120 to be controlled by a permanent magnet 121 carried on an end 122 of the switch arm 107 in a manner hereinafter set forth. The contacts 118 and 119 of the reed switch means 112 are respectively electrically interconnected to the leads 115 and 116 in a manner well known in the art.

Figure 11:
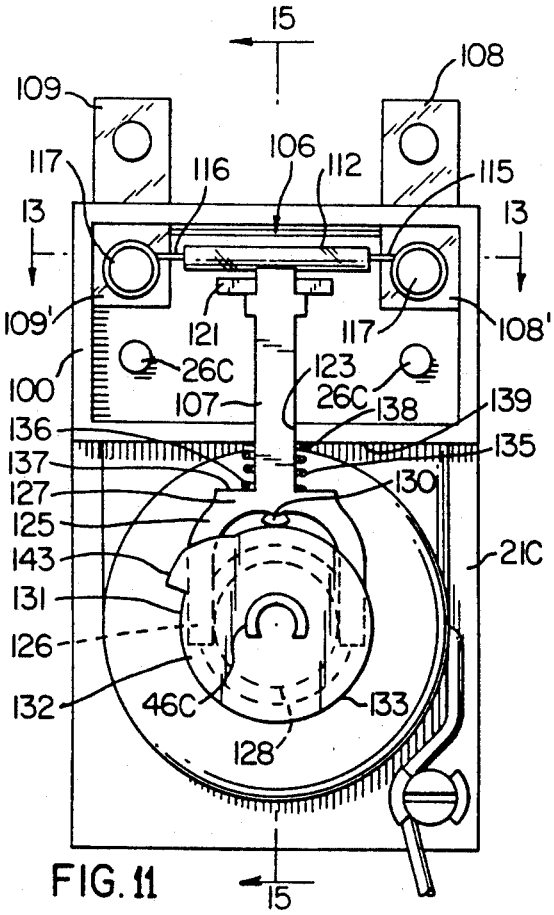
FIG. 11 is an enlarged front view of the temperature operated switch construction of FIG. 10 with certain parts removed to illustrate the switch means and switch arm thereof.
Figure 12:
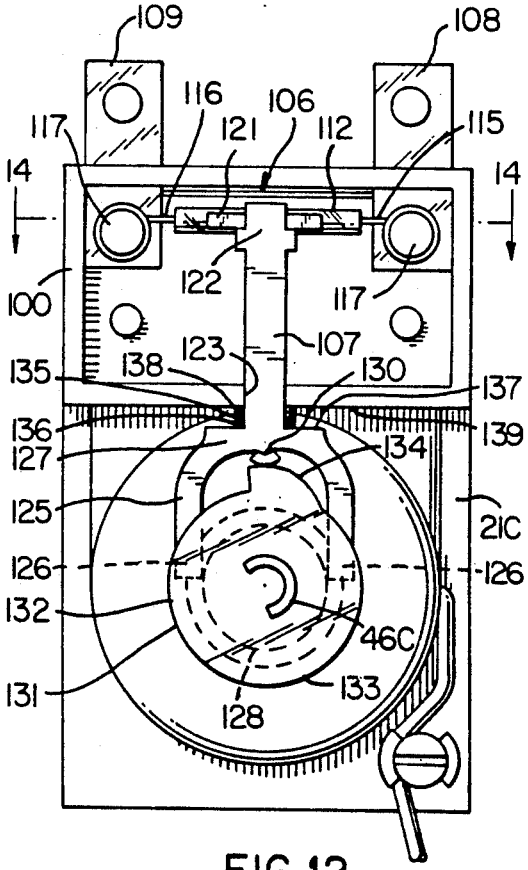
FIG. 12 is a view similar to FIG. 11 and illustrates the switch means and switch arm in another operating position thereof.
Figure 13:
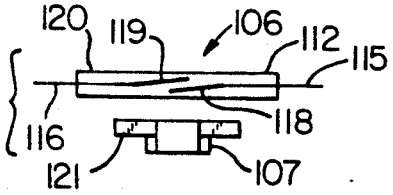
FIG. 13 is a fragmentary cross-sectional view taken on line 13—13 of FIG. 11.
Figure 14:
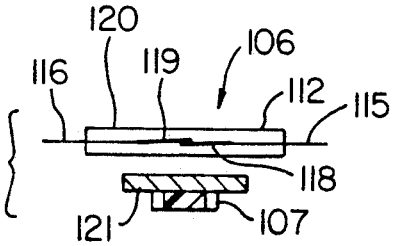
FIG. 14 is a fragmentary cross-sectional view taken on line 14—14 of FIG. 12.
Figure 16:
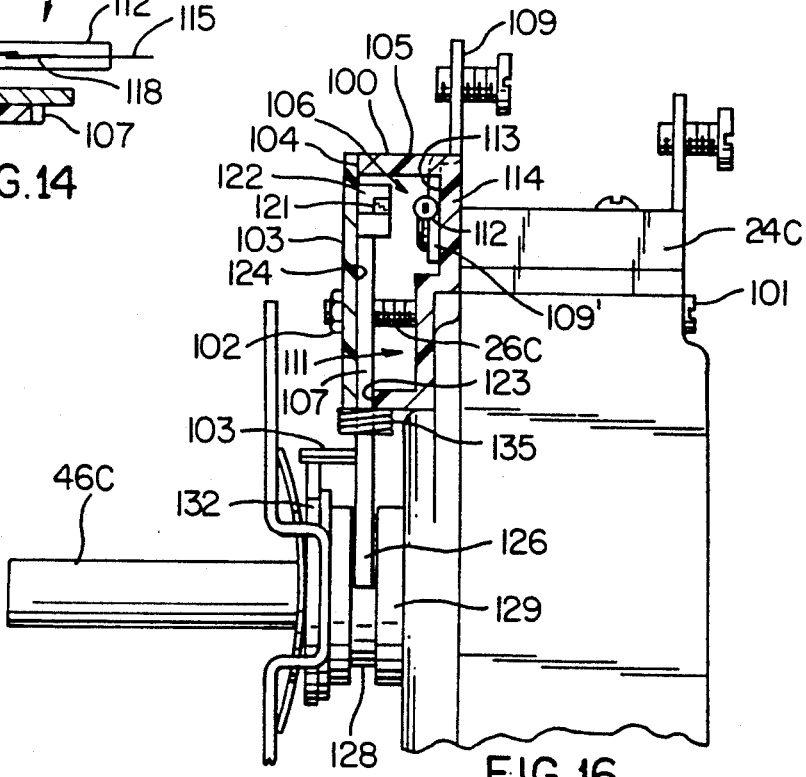
FIG. 16 is a fragmentary view similar to FIG. 15 and illustrates the switch means and the switch arm in another operating position thereof.

The reed switch means 112 is of the normally open type so that the contacts 118 and 119 are disposed in the open condition thereof by the natural resiliency of the contacts 118 and 119 when the permanent magnet 121 is held by the switch arm 107 in the away position illustrated in FIGS. 11, 13 and 15 and are closed when the permanent magnet 121 is moved by the switch arm 107 to the near position illustrated in FIGS. 12, 14 and 16.

The switch arm 107 is adapted to be moved from the position illustrated in FIG. 15 to the position illustrated in FIG. 16 in substantially a straight-line manner that is in a direction substantially transverse to the longitudinal axis of the reed switch means 112 and is substantially parallel thereto as the switch arm 107 projects through a slot means 123 in the terminal block 100 and slides against an inside flat surface 124 of the front cover 103 in the manner illustrated in FIGS. 15 and 16.

The switch arm 107 can be formed of any suitable material, such as a nonmagnetic polymeric material, and has another end 125 formed in a substantial U-shape that comprises a pair of legs 126 and a cross member 127 whereby the legs 126 respectively ride in an annular groove 128 on a cylindrical part 129 carried on the shaft means 46C whereby the groove 128 guides the up and down movement of the switch arm 107 in the manner illustrated in FIGS. 11 and 12.

The cross member 126 of the end 125 of the switch arm 107 has a cam follower tang 130 extending outwardly therefrom and being disposed in engagement with a cam surface 131 of a cam 132 that is carried by the control shaft 46C and rotates in unison therewith, the cam surface 131 having a substantially circular cam surface portion 133 and a cam rise high surface portion 134 so that as long as the cam follower 130 is disposed against the circular cam surface 133, the switch arm 107 remains in the position illustrated in FIG. 11 so that the reed switch 112 is in an open condition thereof but when the high rise cam surface 134 of the cam 132 is in engagement with the cam follower 130 in the manner illustrated in FIG. 12, the switch arm 107 has been moved axially upwardly in the manner illustrated in FIG. 12 to place the permanent magnet 121 in a near position adjacent the reed switch 112 to close the contacts 118 and 119 thereof in the manner illustrated in FIG. 14.

In order to move the switch arm 107 back from the position illustrated in FIG. 12 to the position illustrated in FIG. 11 when the shaft 46C is turned to a position thereof that causes the circular portion 133 of the cam 132 to be adjacent the cam follower 130 of the switch arm 107, a compression spring 135 is disposed in telescoping relation on the switch arm 107 so as to have one end 136 thereof bear against a flat surface 137 of the cross member 127 of the switch arm 107 and another end 138 thereof bear against an external surface 139 of the terminal block 100 in the manner illustrated in FIGS. 11 and 12 so that the compression spring 135 is compressed when the switch arm 107 is in the up position as illustrated in FIG. 12 and will force the switch arm 107 downwardly to maintain the cam follower against the cam surface 131 of the cam 132 when the cam 132 has been rotated to the switch off condition thereof wherein the circular portion 133 of the cam surface 131 is to be in engagement with the cam follower 130 in the manner illustrated in FIG. 11.

Therefore, it can be seen that in the operation of the temperature operated switch construction 20C, the shaft 46C can be rotated through a certain rotational range thereof so that the same merely adjusts the temperature setting of the temperature actuated means 44C for controlling the switch means 32C thereof while the switch means 106 remains in the open condition as illustrated in FIG. 13 as such rotational position of the control shaft 46C is merely disposing the circular portion 133 of the cam surface 131 against the cam follower 130 so that the force of the compression spring 135 maintains the switch arm 107 in its down condition as illustrated in FIG. 11.

However, when the control shaft 46C is rotated to a position where the high rise portion 134 thereof is against the cam follower 130, the switch arm 107 is moved upwardly as illustrated in FIG. 12 so that the permanent magnet 121 is in a position adjacent the reed switch 106 to cause the contacts 118 and 119 to be disposed in a closed condition thereof as illustrated in FIG. 14.

A subsequent rotation of the control shaft 46C to move the high rise portion 134 of the cam surface 131 of the cam 132 away from the cam follower 130 permits the compression spring 135 to move the switch arm 107 downwardly in the manner illustrated in FIG. 11 so that the magnet 121 is moved downwardly and its magnetic field is in such a position that same is not sufficient to overcome the normal flexure of the contacts 118 and 119 so that the contacts 118 and 119 open in the manner illustrated in FIG. 13.

While the temperature operated switch construction 20C of this invention has been described and illustrated as utilizing a reed switch 112 which is in a normally open condition thereof when the magnet 121 is disposed away from the same, it is to be understood that the switch construction 20C of this invention can utilize a reed switch wherein the contacts thereof are normally in a closed condition thereof.

For example, reference is now made to FIGS. 17–20 wherein another temperature operated switch construction of this invention is generally indicated by the reference numeral 20D and parts thereof similar to the parts of the switch constructions 20, 20A, 20B and 20C previously described are indicated by like reference numerals followed by the reference letter "D".

Figure 17:
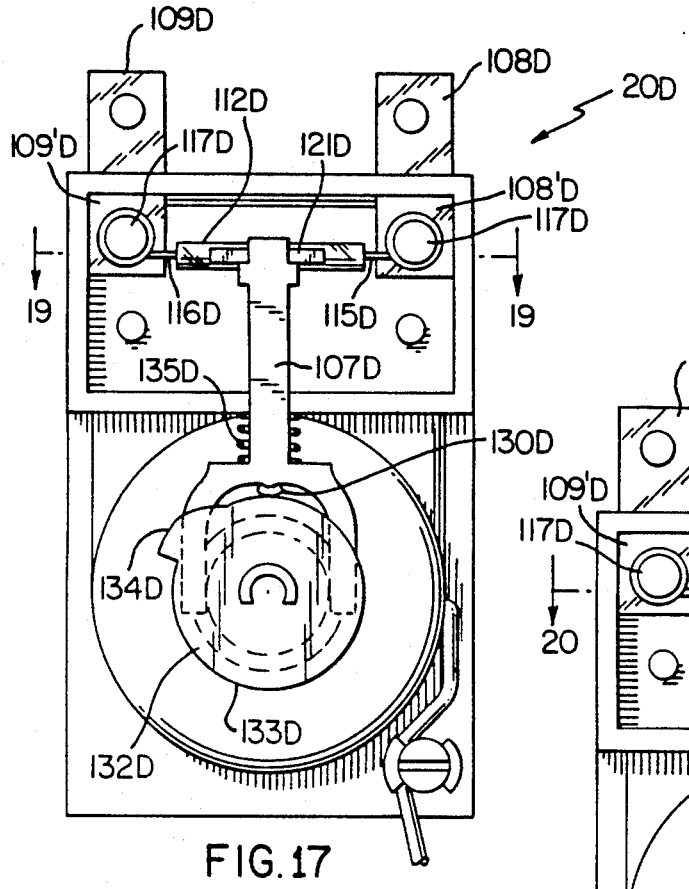
FIG. 17 is a view similar to FIG. 15 and illustrates another temperature operated switch construction of this invention.
Figure 18:
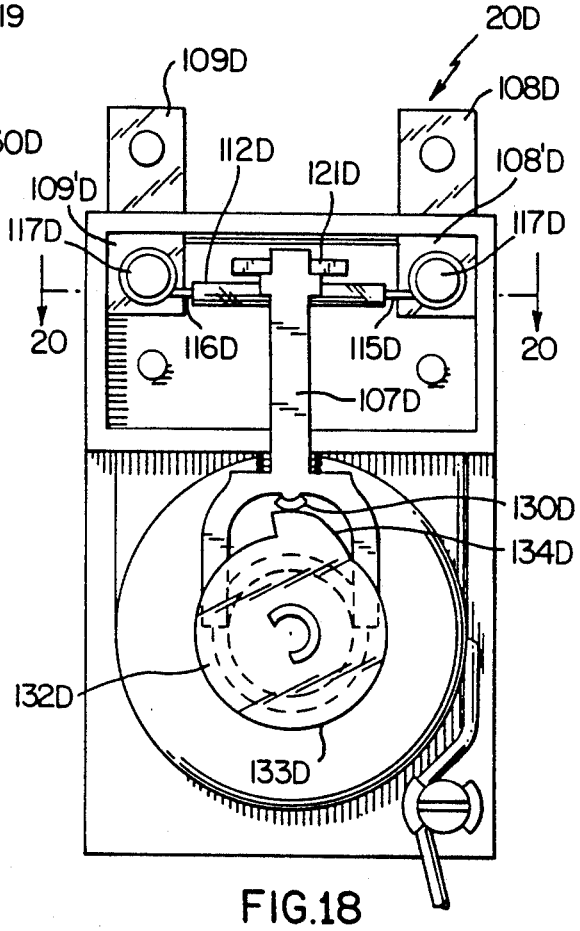
FIG. 18 is a view similar to FIG. 17 and illustrates the switch means and the switch arm in another operating position thereof.

As illustrated in FIGS. 17 and 18, it can be seen that the temperature operated switch construction 20D is substantially identical to the temperature operated switch construction 20C previously described except that the reed switch means 112D thereof is of the normally closed type and that the same has its leads 115D and 116D fastened to the terminal portions 108'D and 109'D by the fastening means 117D so that the reed switch means 112D is disposed adjacent the magnet 121D carried by the switch arm 107D when the switch arm 107D has the cam follower portion 130D thereof disposed against the circular portion 133D of the cam member 132D. In this manner, the switch arm 107D moves the magnet 121D away from the reed switch 112D in the manner illustrated in FIG. 18 when the high rise portion 134D of the cam 132D is acting on the cam follower 130D of the switch arm 107D.

Figure 19:
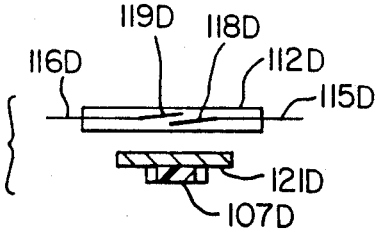
FIG. 19 is a fragmentary cross-sectional view taken on line 19—19 of FIG. 17.

Thus, it can be seen in FIGS. 17 and 19 that when the magnet 121D is held adjacent the reed switch 112D, the magnetic field of the magnet 121D causes the contacts 118D and 119D to be moved to an open condition in opposition to the natural force of the contacts 118D and 119D that tend to cause the contacts 118D and 119D to be disposed in a closed condition thereof.

Figure 20:
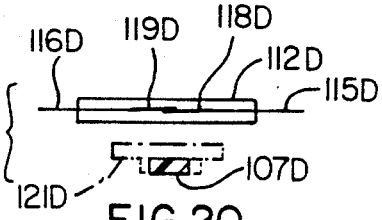
FIG. 20 is a fragmentary cross-sectional view taken on line 20—20 of FIG. 18.

Accordingly, when the magnet 121D is moved away from the reed switch means 112D in the manner illustrated in FIGS. 18 and 20, the magnetic field of the permanent magnet 121D has been moved so that it does not have sufficient strength to overcome the natural flexure of the contacts 118D and 119D so that the contacts 118D and 119D close in the manner illustrated in FIGS. 18 and 20 so as to electrically interconnect the terminals 108D and 109D together.

However, when the switch arm 107D is moved downwardly from the position illustrated in FIG. 18 back to the position illustrated in FIG. 20, the magnetic field of the magnet 121D again opens the contacts 118D and 119D so that the terminals 108D and 109D are no longer electrically interconnected together by the switch means 112D.

Thus, it can be seen that this invention permits the structure of a temperature operated switch construction that has been originally designed to operate electrical switches wherein the switch arms thereof respectively carry electrical contacts for closing against fixed contacts when the switch arms are respectively moved to certain operating conditions thereof, to merely have the switch arms modified in the manner previously set forth to carry permanent magnets so as to operate reed switches that are disposed in place of the fixed contacts without requiring extensive modification of such structure of the prior known temperature operated switch constructions.

In this manner, the temperature operated switch construction that has been modified according to the teachings of this invention can still be utilized for its intended application, such as having the temperature actuated switch means 32C or 32D control a bake heating element of a cooking apparatus and the shaft controlled switch means 112 or 112D control a broil heating element of the cooking apparatus.

Therefore, not only does this invention provide a new temperature operated switch construction and a new terminal block therefor, but also this invention provides a new method of making a temperature operated switch construction and a new method of making a terminal block therefor.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a temperature operated switch construction comprising a housing means, a first movable switch arm carried in said housing means, temperature actuated means disposed in said housing means and being operatively interconnected to said first switch arm to cause movement of said first switch arm between operating positions thereof in relation to the temperature being sensed by said temperature actuated means, said housing means carrying a first switch means that is operatively associated with said first switch arm so that said first switch means is in a first condition thereof when said first switch arm is in a first operating position thereof and said first switch means is in a second condition thereof when said first switch arm is in a second operating position thereof, said switch construction comprising a second movable switch arm carried by said housing means, and actuator means carried by said housing means and being operatively interconnected to said second switch arm to cause movement of said second switch arm between operating positions thereof in relation to the condition of said actuator means, said housing means carrying a second switch means that is operatively associated with said second switch arm so that said second switch means is in a first condition thereof when said second switch arm is in a first operating position thereof and said second switch means is in a second condition thereof when said second switch arm is in a second operating position thereof, the improvement wherein said first switch means comprises a first reed switch means and wherein said first switch arm carries a first magnet means for operating said first reed switch means to said conditions thereof as said first switch arm is moved to said positions thereof, said second switch means comprising a second reed switch means, said second switch arm carrying a second magnet means for operating said second reed switch means to said conditions thereof as said second switch arm is moved to said positions thereof in a direction that is generally parallel to said second reed switch means.

2. A switch construction as set forth in claim 1 wherein said second reed switch means comprises a single reed switch.

3. A switch construction as set forth in claim 2 wherein said second reed switch comprises a normally open reed switch.

4. A switch construction as set forth in claim 2 wherein said second reed switch comprises a normally closed reed switch.

5. A switch construction as set forth in claim 1 wherein said second reed switch means has a longitudinal axis, said second switch arm being movable between said positions thereof in a direction that is generally transverse to said longitudinal axis.

6. A switch construction as set forth in claim 5 wherein said second magnet means of said second switch arm always remains spaced from said second reed switch means.

7. A switch construction as set forth in claim 1 wherein said housing means has an opening therein, said second switch arm projecting through said opening.

8. A switch construction as set forth in claim 7 wherein said switch construction has a rotatable cam operatively associated with said second switch arm to move said second switch arm between said positions thereof.

9. A switch construction as set forth in claim 7 wherein said actuator means comprises a rotatable shaft means having means operatively associated with said cam to rotate said cam therewith.

10. A switch construction as set forth in claim 1 wherein said first reed switch means comprises a single reed switch.

11. A switch construction as set forth in claim 1 wherein said first reed switch means comprises a plurality of separate reed switches.

12. A switch construction as set forth in claim 1 wherein said housing means has spaced apart stop means that are respectively engaged by said first switch arm and thereby determines said positions thereof.

13. A switch construction as set forth in claim 12 wherein said housing means has a terminal block, said terminal block comprises two parts adjustably secured together whereby the position of one of said parts can be adjusted relative to the other of said parts.

14. A switch construction as set forth in claim 13 wherein said first reed switch means is carried by one of said parts of said terminal block.

15. A switch construction as set fort in claim 14 wherein the other of said parts of said terminal block has said stop means.

16. A switch construction as set forth in claim 15 wherein said other of said parts of said terminal block has an opening therethrough that defines two facing and spaced apart surface means, said two surface means comprising said stop means, said first reed switch means having a longitudinal axis and being carried by said one of said parts of said terminal block so that said axis thereof is generally parallel to said surface means.

17. A switch construction as set forth in claim 13 wherein said two parts of said terminal block respectively have facing surfaces disposed in sliding relation and having spline means splining said surfaces together so as to limit the sliding movement therebetween.

18. In a method of making a temperature operated switch construction comprising a housing means, a first movable switch arm carried in said housing means, temperature actuated means disposed in said housing means and being operatively interconnected to said first switch arm to cause movement of said first switch arm between operating positions thereof in relation to the temperature being sensed by said temperature activated means, said housing means carrying a first switch means that is operatively associated with said first switch arm so that said first switch means is in a first condition thereof when said first switch means is in a first operating position thereof and said first switch means is in a second condition thereof when said first switch arm is in a second operating position thereof, said switch construction comprising a second movable switch arm carried by said housing means, and actuator means carried by said housing means and being operatively interconnected to said second switch arm to cause movement of said second switch arm between operating positions thereof in relation to the condition of said actuator means, said housing means carrying a second switch means that is operatively associated with said second switch arm so that said second switch means is in a first condition thereof when said second switch arm is in a first operating position thereof and said second switch means is in a second condition thereof when said second switch arm is in a second operating position thereof, the improvement comprising the steps of forming said first switch means to comprise a first reed switch means, disposing a first magnet means on said first switch arm to be carried thereby for operating said first reed switch means to said conditions thereof as said first switch arm is moved to said positions thereof, forming said second switch means to comprise a second reed switch means, and disposing a second magnet means on said second switch arm to be carried thereby for operating said second reed switch means to said conditions thereof as said second switch arm is moved to said positions thereof in a direction that is generally parallel to said second reed switch means.

* * * * *

UNITED STATES PATENT AND TRADEMARK OFFICE

CERTIFICATE OF CORRECTION

PATENT NO. : 5,231,368
DATED : July 27, 1993
INVENTOR(S) : Thomas M. Buckshaw et al It is certified that error appears in the above-indentified patent and that said Letters Patent is hereby corrected as shown below:

On the title page:

*Notice

The term of this patent subsequent to January 26, 2010, has been disclaimed.

Signed and Sealed this

Third Day of May, 1994

Bruce Lehman

*Attest:*

BRUCE LEHMAN

*Attesting Officer*

*Commissioner of Patents and Trademarks*